US005408710A

United States Patent [19]

Garman et al.

[11] Patent Number: 5,408,710

[45] Date of Patent: Apr. 25, 1995

[54] LIFTING APPARATUS

[75] Inventors: David E. T. Garman, Llandrindod Wells; Richard M. Rimington, Presteigne; Richard E. Fletcher, Leominster, all of United Kingdom

[73] Assignee: Mangars International Limited, Powys, Wales

[21] Appl. No.: 84,526

[22] Filed: Jun. 29, 1993

[51] Int. Cl.[6] ..... A47C 20/02; A47C 7/52

[52] U.S. Cl. ..... 5/81.1; 5/624; 5/648; 297/423.4; 297/423.3

[58] Field of Search ..... 5/81.1, 624, 648–652, 5/657, 426, 427, 658, 449, 453; 297/423.1, 423.3, 423.4; 254/93 HP

[56] References Cited

U.S. PATENT DOCUMENTS

| | | | |
|---|---|---|---|
| 4,104,425 | 8/1978 | Hirmann | 5/81.1 X |
| 4,153,958 | 3/1979 | Paulik | 5/453 X |
| 4,337,921 | 7/1982 | Edwards | 254/93 HP |
| 4,629,162 | 12/1986 | Porché | 254/93 HP |
| 5,097,553 | 3/1992 | Boland | 5/648 |
| 5,113,875 | 5/1992 | Bennett | 5/648 X |
| 5,179,744 | 1/1993 | Foster et al. | 5/449 X |

*Primary Examiner*—Michael F. Trettel
*Attorney, Agent, or Firm*—Neil F. Markva

[57] ABSTRACT

A lifting device locatable proximal to a chair for raising and lowering a person's legs by an inflatable bag providing a pneumatically resilient leg supporting cushion, which bag is supported by a mounting interposed between the bag and the chair, the mounting being in engagement with the chair to determine the position of the mounting. The mounting is preferably held in position by legs of the chair resting on abutments provided on the mounting; and the mounting is preferably geometrically adjustable.

18 Claims, 6 Drawing Sheets

LIFTING APPARATUS

BACKGROUND OF THE INVENTION

A lifting device is known which comprises a rigid stand, a rigid panel having a rear end connected by a hinge to an upper part of the stand, and an inflatable bellows between a front of the stand and an underside of the panel. The device is of free standing form, and is arranged so that inflation of the bellows pivots the panel from a condition depending from the hinge to lie alongside the stand to a raised condition projecting forwardly from the upper part of the stand. The device is expensive, heavy for a partially disabled person to lift and maneuver into position, is cumbersome to store and transport because of its bulk, and restricts movement of the user's feet thus hindering egress from the chair.

An object of the invention is to enable such problems to be reduced or avoided.

SUMMARY OF THE INVENTION

According to the present invention there is generally provided a lifting device comprising an inflatable bag having a rear portion connected to a mounting locatable proximal to a seat of a chair or a mattress of a bed; wherein the inflatable bag is inflatable to provide a pneumatically resilient leg supporting cushion projecting from said mounting.

An embodiment of the present invention provides a lifting device which comprises a pneumatic bag and a mounting, and which is characterized in that a rear part of the mounting is insertable between a base and a mattress or cushion on the base of a bed or chair, and in that the pneumatic bag is attached to a front part of the mounting to project upwardly or in cantilever manner from the mounting when inflated.

In use the support part is very easily inserted between a base of a bed or chair and a mattress or seat cushion thereon until at least part of the mounting abuts an upright surface of the base, so that the bag is movable, by being inflated, from a position in which it hangs from and extends below the mounting, to a position extending above or alongside the mattress or seat cushion, to offer maximum comfortable help with minimal obstruction and discomfort to a person using the chair.

According to the present invention there is further provided a lifting device comprising a mounting and a pneumatically inflatable bag, wherein a rear part of the bag is secured to a front part of the mounting; wherein a support part of the mounting extends rearwards from said front part of the mounting; and wherein the bag is inflatable to raise an end portion of the bag from a position dependant below the level of the front part of the mounting to a position above the front part of the mounting.

The front part of the mounting may be separable from the support part of the mounting, and the support part preferably comprises locating members on which part of a chair can rest to hold down the locating members to avoid having to use clamps or other fixings on the chair. The locating members are preferably adjustable for length and/or height to adapt the mounting to suit a variety of chairs.

The invention further provides a lifting device comprising a bag and a mounting, wherein the mounting comprises a front part attached or attachable to a rear end of the bag, and a rear part providing an abutment or abutments for interposition between an item of furniture on a floor on which said item is supported, and wherein the mounting is adjustable to determine the relative angular and linear geometrical relationship between the front part and the abutment or abutments.

The rear or support part is preferably separable, retractable or otherwise capable of being reduced, in overall dimensions for stowage, in a volume less than 20% greater than (and preferably comparable to) that required for stowage of the deflated bag and its attached parts.

In contrast to known forms of leg supports requiring substantial free standing stands or fittings for rigid attachment to furniture framework, the device of the invention can, under most circumstances, utilize the weight of a person sitting or lying on the cushion or mattress, or the weight of the item of furniture to clamp the mounting down on the base or floor, while the bag itself is employed as a resilient support for the person's leg or legs.

The device can be constructed easily so as to be light, compact and relatively inexpensive. One form of the mounting may be made from flexible material e.g. fabric, and other forms may be made from light and rigid materials such as wood or inexpensive materials such as steel.

The construction of the bag may employ a body of "drop-thread" material in which threads link major, e.g. upper and lower, panels of the bag to keep such panels generally in a predetermined relationship, e.g. parallel, when the bag is inflated.

The rear of the bag is preferably provided with webs which are attached, e.g. bonded, to the mounting.

A tube or tubes for inflating the bag is or are preferably attached to the rear or lower end of the bag.

There is a further problem involved in lifting the leg or legs of a person where such lifting involves flexure of the knee joint or joints, in that discomfort or pain can be caused or exacerbated if the apparatus utilized to cause such movement applies localized forces or unwanted directional forces.

In preferred embodiments of the present invention, unwanted directional forces are minimized by making the bag move about a notional axis very close to the user's knee Joint. This can be achieved by arranging a connection between the bag and the mounting to lie above the top of the mounting, but such an arrangement may have the disadvantage, in circumstances where a soft cushion or mattress is used to support a heavy person, that the connection abuts and applies localized force to the underside of the user's knee or knees when the bag is deflated.

In order to avoid such localized forces, the bag is preferably configured or constrained so that during inflation an intermediate portion of the bag, between a part of the bag attached to the mounting and a free end portion of the bag, becomes inflated to rise above the mounting and serves a hinge zone about which the free end portion of the bag moves upwards in a quasi-pivotal manner.

The configuration of the bag may be such that the free end portion is, when inflated, thinner than the remainder of the bag, e.g. by stepping or tapering the thickness of the intermediate portion. Alternatively or additionally the bag may be constrained by having a further inflatable bag attached to said remainder.

The apparatus may be horizontally elongate so that the free end portion, when inflated to an upstanding condition, can serve as a wall or side member for a cot or bed, to prevent a person rolling out of the cot or bed.

The invention includes a chair, seat, bed, cot or like support for a person incorporating or provided with the lifting device of the invention.

In all embodiments, the bag provides a panel which offers large area pneumatically soft and resilient support for the underside of a user's leg during lifting.

BRIEF DESCRIPTION OF DRAWINGS

The invention will be described further, by way of example, with reference to the accompanying diagrammatic drawings, wherein.

DETAILED DESCRIPTION

Figure 1:
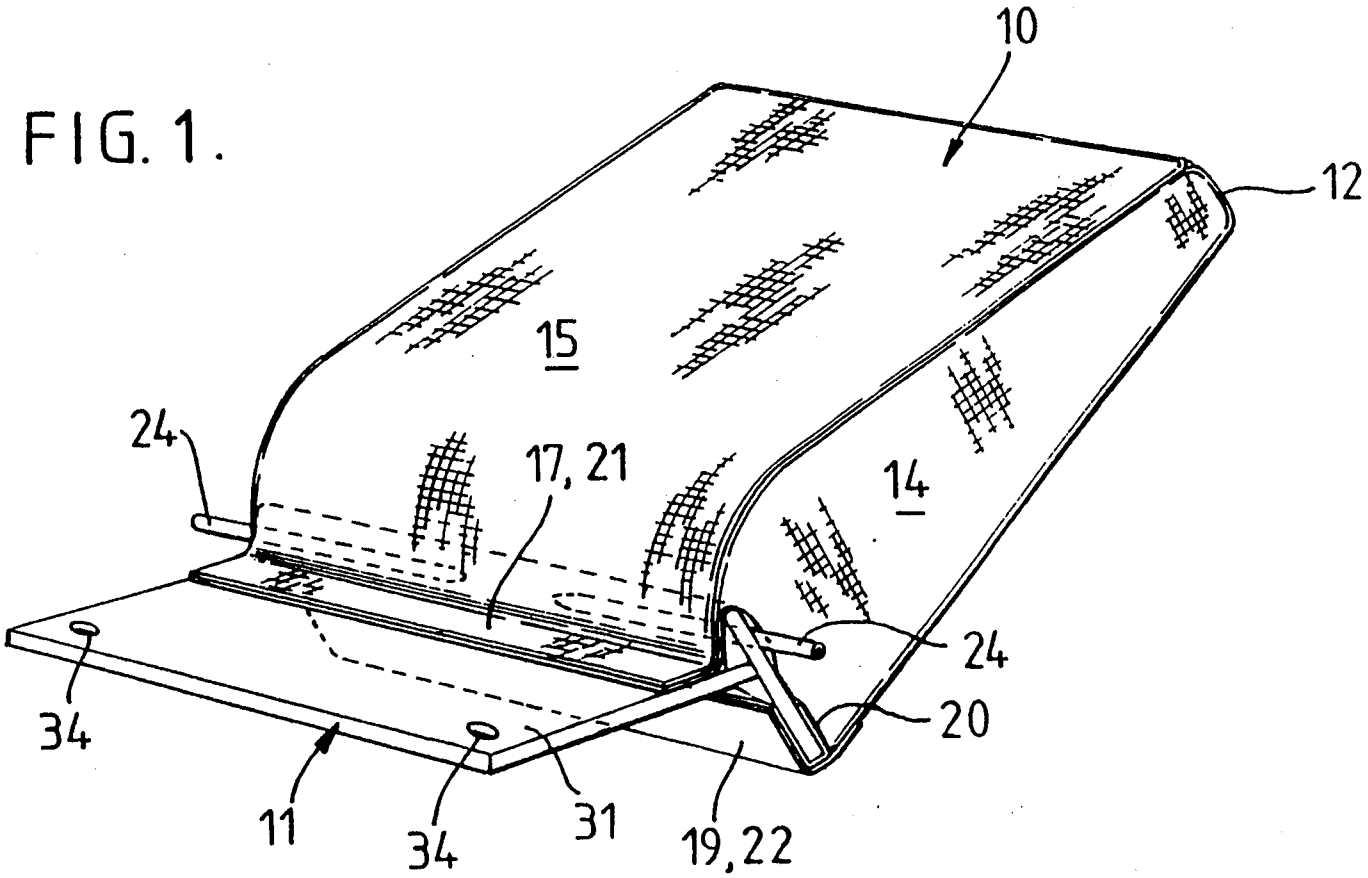
FIG. 1 shows a perspective view of a first embodiment of lifting device of the invention.

The lifting device primarily comprises the pneumatic bag 10, 10A or 10B and a mounting 11, 11A or 11B.

In the first embodiment, the bag 10 has, at the front and rear ends 12 and 13, walls of impervious, flexible and substantially inelastic material, which are some 40 cm wide; and has parallel side walls 14 of similar material which taper in width and height so that upper and lower surfaces 15 and 16 are convergent toward front end 12, as shown. The upper and lower surfaces 15 and 16 of the bag may be provided by separate panels of the same material as the walls 14. The upper and lower panels carrying respective surfaces 15 and 16 may be linked by threads to limit the spacing between the upper and lower panels when the bag is inflated. These panels may be treated so as to be impervious or be bonded to sheets of impervious material.

The rear end part of the bag 10 has four attachment webs 17, 18, 19 and 20 of flexible inelastic material, such as woven plastics, bonded thereto. The webs 17 and 18 are bonded together for about half their width to form an upper flap 21, and other parts of webs 17 and 18 are bonded to the rear wall 13 and upper surface 15 as shown; and the webs 19 and 20 are similarly joined to form a lower flap 22 and are bonded to the rear wall 13 and lower surface 16, so that the flaps 21 and 22 extend transversely of the bag 10 along the upper and lower margins of the rear wall 13.

The rear wall 13 includes sealed anchorages 23 for two inflation tubes 24, for inflation and deflation of the bag 10 and for receiving a pressure relief safety valve (not shown).

The mounting 11 comprises a front part or upright member 30 and a rear or support member 31 both made from 1 cm thick fiber board or plywood, which are joined together so that the member 31 extends rearwards from a rear face of the member 30 at about 10° off a right angle. The joint between the members 30 and 31 is reinforced by two wood fillets 32 and 33 bonded to both members. Two apertures 34 are formed in a rear part of the support member 31. Both members are about 40 cm wide, the upright member 30 is slightly less than 14 cm high, and the front to rear depth of the support member 31 is about 20 cm.

The bag 10 and mounting 11 are joined together by the flaps 21 and 22 which are folded over the upper and lower edges of the upright member 30 and are secured (permanently or releasably) so as to hold the rear wall 13 of the bag 10 against the front face of the upright member 30 except where the tubes 24 extend therebetween.

Figure 2:
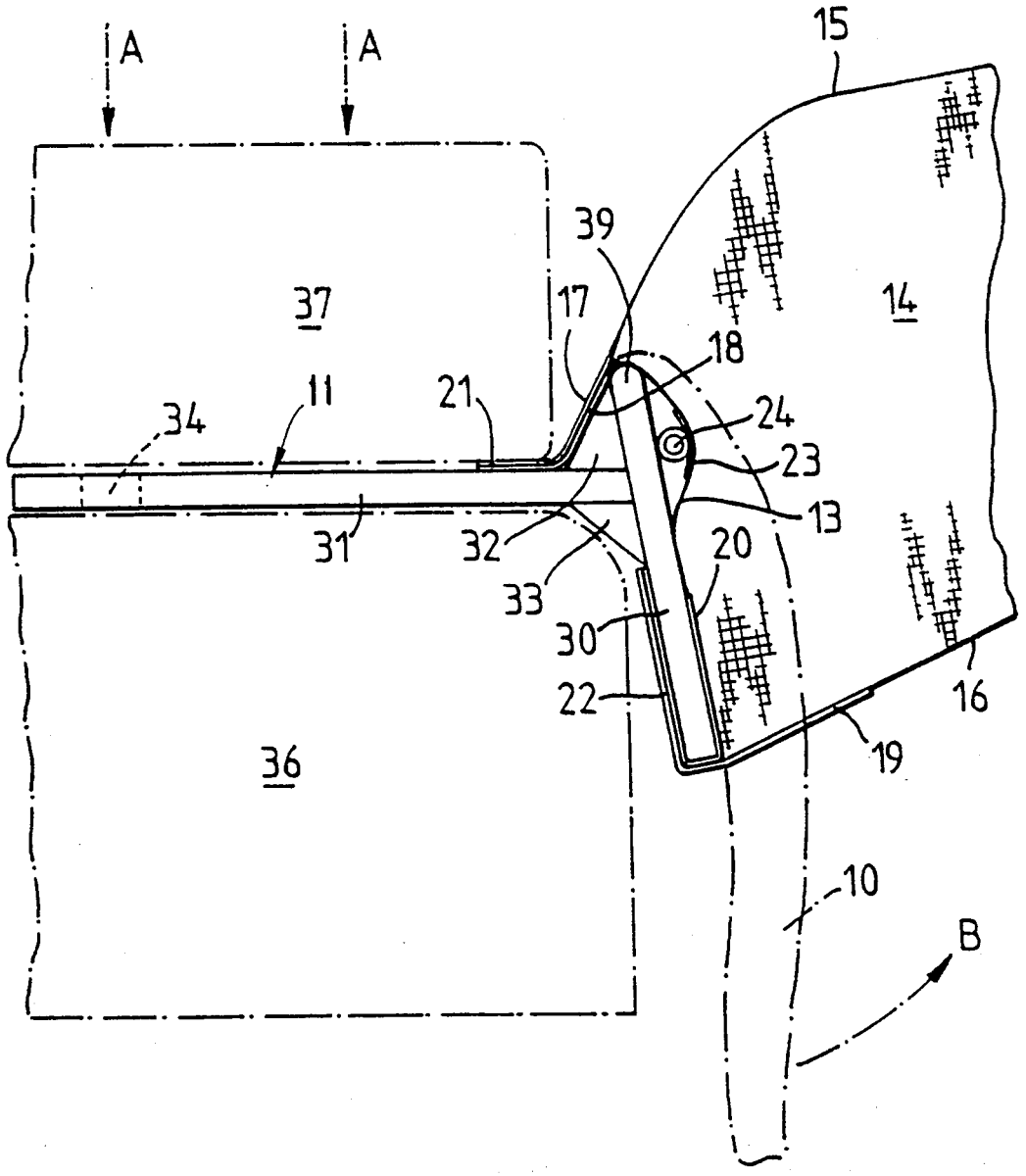
FIG. 2 is an enlarged side elevation of part of the first embodiment device in an in-use condition.

In use, the support member 31 is inserted between a base 36 of a bed or chair and an overlying member 37 such as a mattress of the bed or a seat cushion of the chair, until the upright member abuts the base 36 and a lower part of the member 37, as indicated in FIG. 2. Additional fixing may provided by tethers passed through the holes 34 and secured to the structure of the chair or bed.

The device is stabilized and clamped to the base by the load imparted to the member 37 in the direction of arrows A, by a person sitting or lying upon the member 37 in a position in which the person's knee or knees is or are spaced above the upright member 30. In that position, the person's lower limb or limbs can be raised and lowered gently and easily by inflation and deflation of the bag from a low pressure air supply and venting apparatus (not shown).

It will be readily appreciated that inflation causes the bag to move in the direction of arrow B from a collapsed condition depending from the upright member, to a quasi-rigid condition in which it extends to above and is cantilevered forwardly and slightly upwardly from the inclined front face of the upright member.

However, in some circumstances the member 37 may be relatively thin and soft so as to be compressible by a relatively heavy person to the extent that the underside of the person's knee or knees rests on the upper end 39 of the mounting, when the bag is deflated, thus imposing localized and unwanted pressure to said underside, possibly causing pain or discomfort. This possible disadvantage can be reduced by minimizing the elevation of the end 39 above the support member 31, and by curving said upper end 39.

In the second and third embodiments, said disadvantage is obviated in a way that also gives an improved lifting action for the person's leg or legs, by using a pneumatic bag 10A or 10B which includes an intermediate portion 40 constrained by the increased section of the lower end portion 43A to rise to form a cushion 41 (FIG. 6) below the user's knee or knees, which portion 40 serves as a form of pivot about which a free end portion 42 pivots during inflation to lift the user's leg or legs, while a lower end portion 43A inflates to stabilize the bag 10A. The bag 10A or 10B is configured so that when free of any load and fully inflated the portion 42 extends upwards, instead of forward, from the mounting 11A, which comprises a body of stiff or inelastic plastics or fabric to provide a front member 30A secured to a rear face of the lower end portion 43A or 43B to provide a support flap or web 31A projecting rearwards from the bag 10A or 10B to serve as a rear member. Apertures 34 are formed in a rear part of the support flap or web. The lower end portions 43A and 43B of both bags 10A and 10B are provided with the tubes 24 for inflation/deflation and for insertion or connection of a pressure relief valve.

Figure 3:
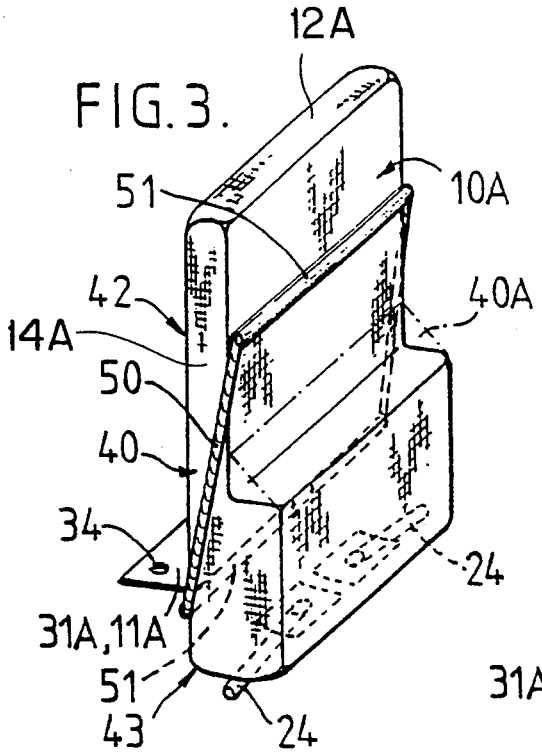
FIGS. 3 and 4 show a perspective view of inflated second and third embodiments respectively of the device.
Figure 6:
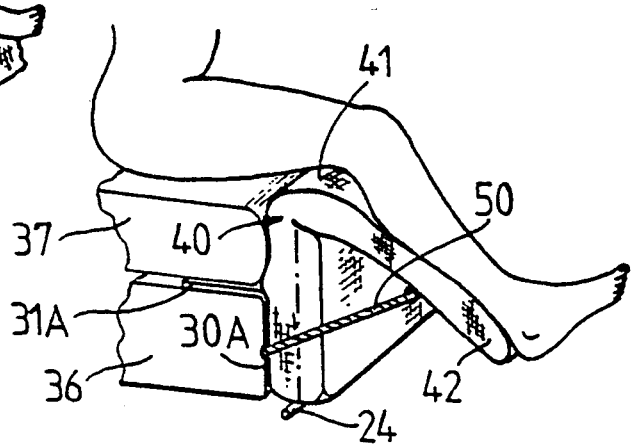

To improve deflation performance which can be rather poor due to the low pressure differential between bag pressure and atmosphere, the air compressor can be used to provide suction instead of compression, or the pressure in the bag may be enhanced using elastic cords 50. Such cords 50 are preferably constrained to run partially in rigid tubes 51 bonded to the lifting bag 10A as depicted in FIGS. 3 and 6. The use of rigid tubes 51 allows a long cord to be employed whereby to improve the ratio of stretched to relaxed length of that part of the elastic running parallel to the side walls 14A of the bag 10A.

In the second embodiment shown in FIG. 3 the lower end portion 43A is thicker (e.g. is about twice the thickness, from front to rear) than the free end portion 42, and the intermediate portion 40 is stepped in thickness to merge with said portions 42, and 43A and 43B. Instead of being stepped, the portion 40 may be tapered as indicated in broken lines at 40A in FIG. 3.

Figure 4:
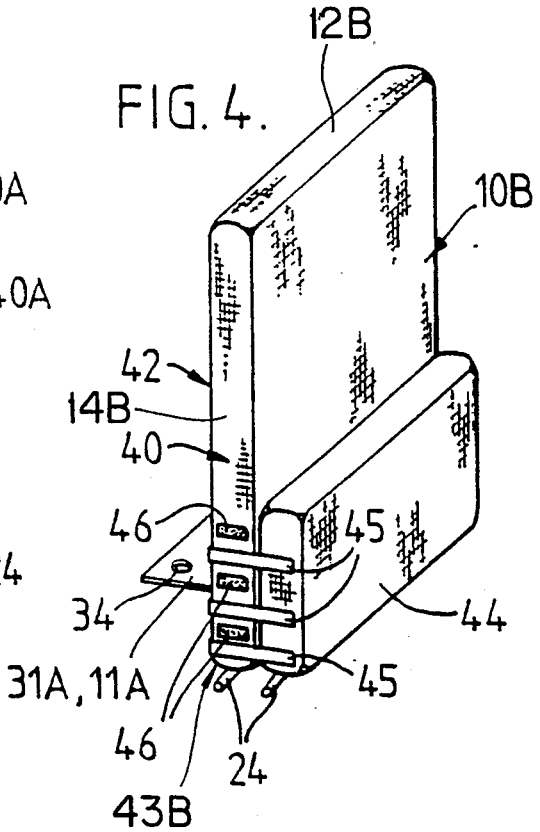

In the third embodiment shown in FIG. 4 the bag 10B is of constant thickness from front to rear, and is employed in conjunction with a secondary bag 44 which is attached to the bag 10B either fixedly, or, as shown, releasably to hook-pile or loop pile fastening tapes 45 preferably having alternative loop pile or hook pile attachment patches 46 on the side and rear faces 14B of the bag 10B, so that the positioning of the bag 44 on the bag 10B can be selectively varied. The overall inflated height of the bag 44 is such that it abuts the front face of the lower portion 43B of the bag 10B to induce portion 40 to provide the hinge about which portion 42 rotates. The bag 44 has respective tubes 24 which may be connected to those of the bag 10B for inflation and deflation of the bags 10B and 44 in unison.

Figure 5:
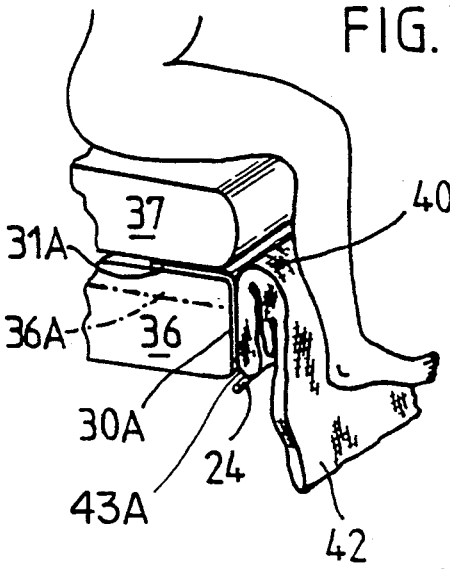
FIGS. 5 and 6 show perspective views of the second embodiment of the device in deflated and partially inflated in-use conditions respectively.

In use, the second and third embodiments function in a generally similar manner, as indicated in FIGS. 5 and 6 in which the second embodiment is depicted in situ with the support flap or flange 31A located between the base 36 and the overlying member 37 so that the rear face of the body 30A abuts one upright face of the base 36, in a similar way to that in which the first embodiment is employed. In the deflated condition, the portions 40 and 42 depend from the upper limit of the attachment of the bag 10A (or 10B) to the body 30A, well below the underside of the user's knee. During inflation of the bag 10A the lower and intermediate portions 43A and 40 become filled and straighten out to provide lift which raises the junction between the intermediate portion 40 and the free end portion 42 to abut said knee undersurface at an inflation pressure at which the free end portion 42 is bent forwards from said junction as shown in FIG. 6. Upon further inflation, the angle of the bend in the bag 10A between the intermediate and free end portions 40 and 42 decreases so that the free end portion swings upwards about a virtual axis positioned closely below the user's knee.

In relation to the third embodiment, the elevation of the virtual axis relative to the bag 10B is determined by the position of the upper end of the bag 44. The positioning of the bag 44 can therefore be selected to suit the thickness (and softness) of the member 37.

Figure 7:
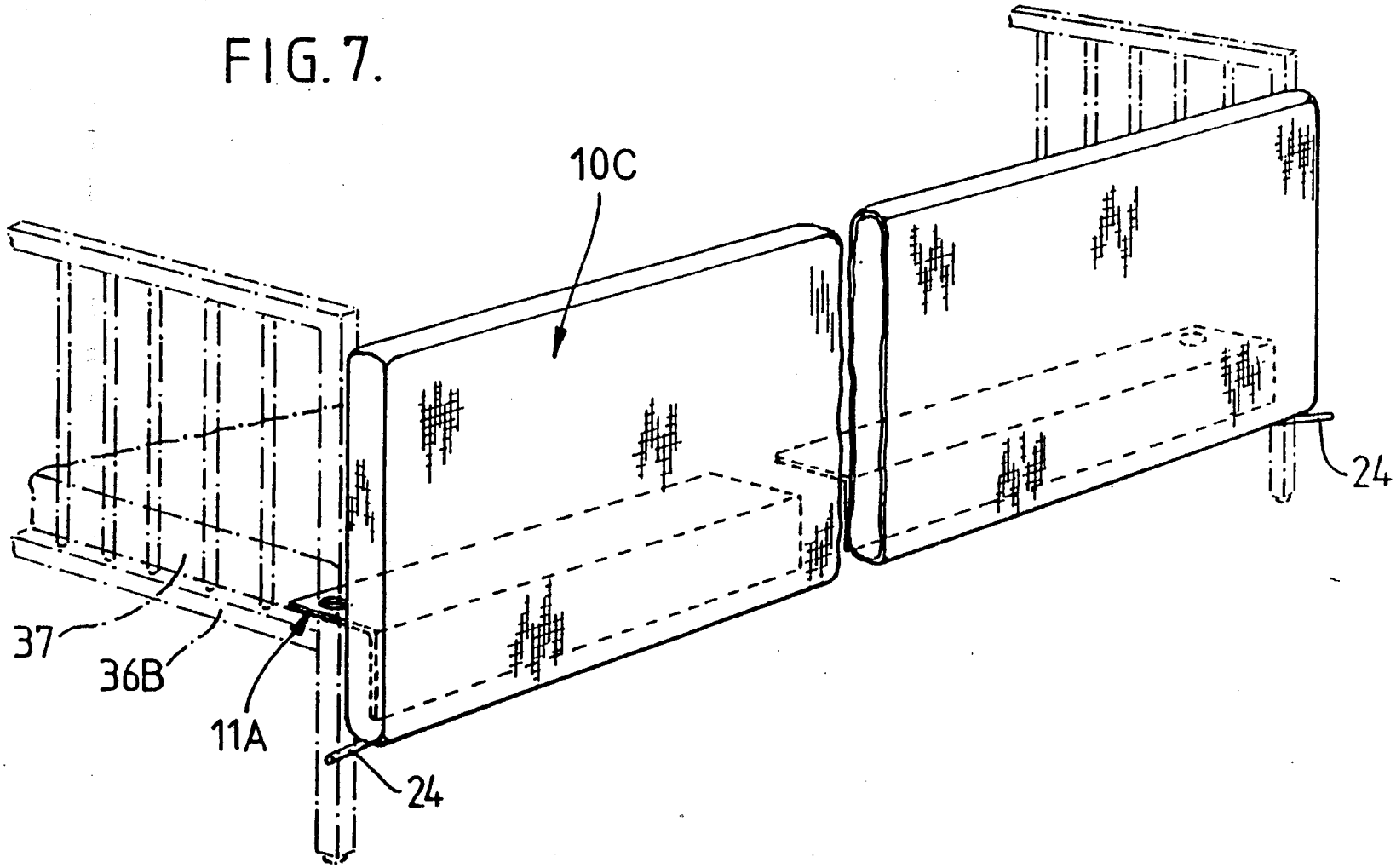
FIG. 7 shows a fourth embodiment of the device.
Figure 8:
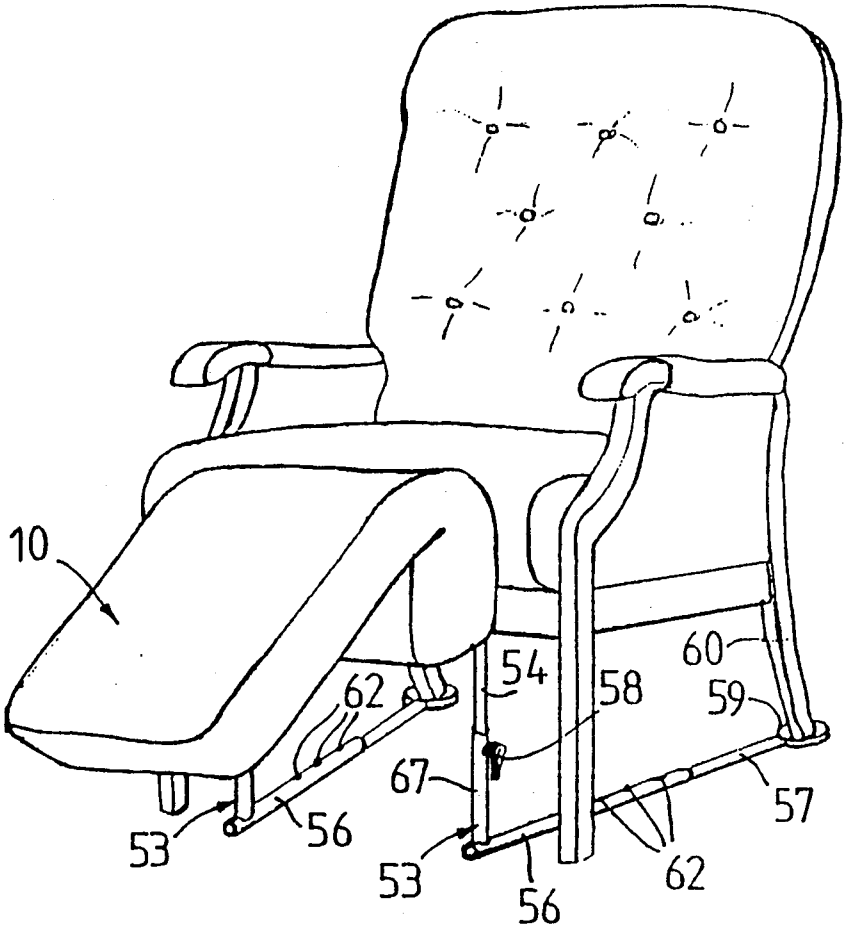
FIG. 8 is a perspective view of a fifth embodiment of the device together with a chair.
Figure 9:
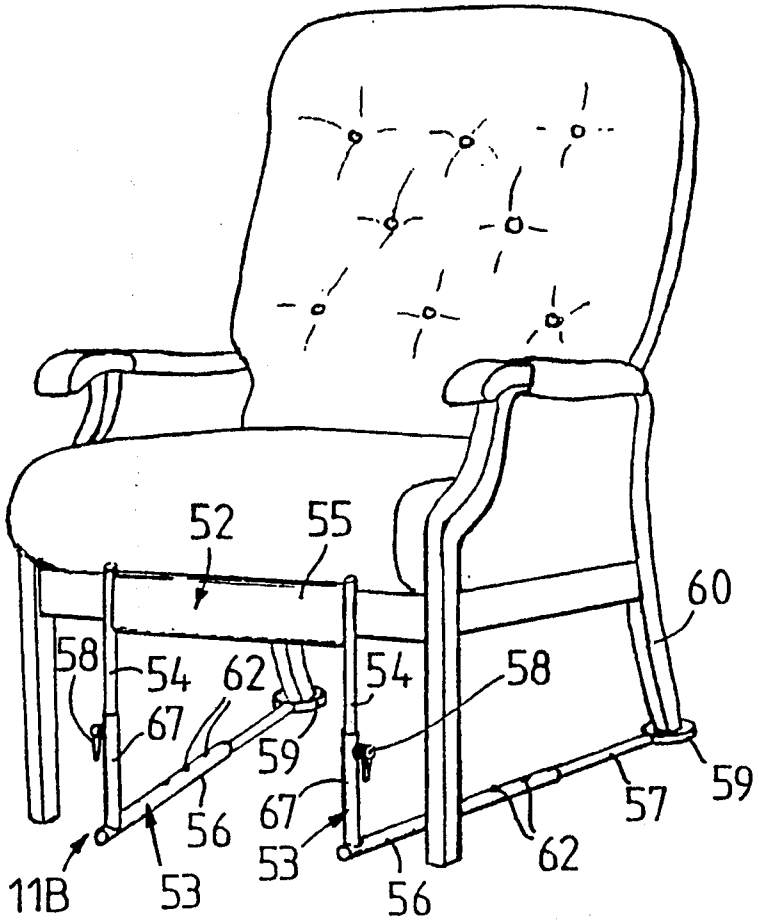
FIG. 9 is a view similar to FIG. 8 with a bag of the device removed to show parts of a mounting of the device.

As can be seen from FIGS. 2 and 3, when the bags 10A and 10B are fully inflated they assume an upstanding condition with the free end walls 12A and 12B uppermost. The bag 10B can assume this condition in the absence of the supplementary bag 44. A plurality of such devices may be utilized to form side walls for a bed (or like elongate support for a person), to restraining a person from rolling out of bed, as well as being useful for helping to raise the person's legs when getting into bed.

Where the device is primarily intended for such a restraining role, a horizontally elongate form of the device may be constructed, as exemplified by the fourth embodiment shown in FIG. 7, in which the bag 10C has a length which is greater than its inflated height.

In some instances, the thickness of the base 36 may be too small to provide the necessary support for the rear face of the body 30A, e.g. the shallow base 36A indicated in broken lines in FIG. 5 or the bed base 36B shown in FIG. 7; and in such instances the mounting 11A is preferably formed from a rigid material or materials, e.g. rigid plastics or aluminium.

In some instances it is not possible or is difficult or inconvenient to lift an overlying member 37 from a base 36, and in other instances there is only an upholstered base 36 without any overlying member, so that it is not possible or not convenient to employ a form of mounting, (such as the mounting 11) in which a support part (such as the support member 31) projects rearwardly directly from the rear of the front part 30 (such as the upright member 30).

In the mounting 11B employed in the fifth embodiment, the front part 70 is attached to the bag (which is indicated in FIGS. 8 to 13 as being the bag 10 or 10A, but equally any of the bags 10, 10A or 10B may be employed) and is separable from a rear support part which serves as the support member.

The rear support part comprises a bridge member 52 and two locating members 53. The bridge member 52 comprises two parallel tubular uprights 54 joined by an elongate crosspiece 55. Bridge member 52 may be, for example, formed from sheet metal such as steel or aluminium and welded to the uprights 54. Each locating member 53 comprises an L-shaped tubular metal link 56, seat abutment 57 and fastening means 58. Seat abutment 57 has a dished head 59 in which a rear leg 60 of the chair can be stood to abut locating member 53 and a shank which fits telescopically in one limb of the link 56 as shown and apertures 62 are formed in this limb and the shank to receive a fixing pin (now shown) to fix the selected horizontal distance between the head 59 and the other limb 67 of the link 56. The uprights 54 are actuably and telescopically received in said other limbs 67 and are secured therein by the fastening means 58 to determine the angular relationship between the members 56, and the height of the crosspiece 55 above the floor on which the locating members 53 rest.

In most instances, depending upon the geometry of the chair, said horizontal distance will be about twice said height, so that the weight of the chair standing on the heads 59 gives sufficient stability to the rear support part to provide ample support for the bag 10 to function as previously described when the front part 70 is fitted to the bridge member 52.

Figure 10:
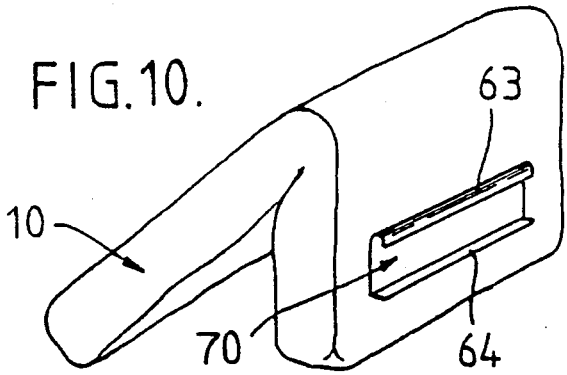
FIGS. 10 and 11 show details of the fifth embodiment.
Figure 11:
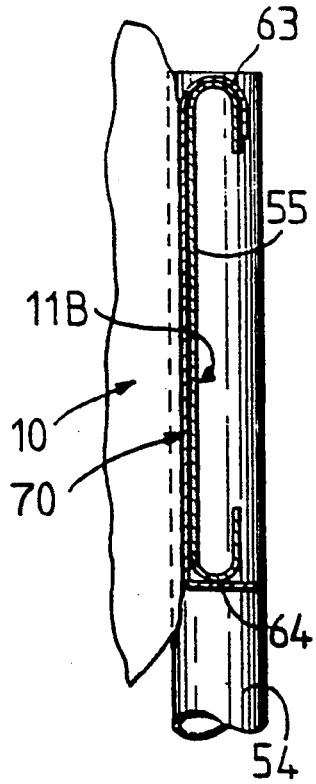

In the form shown in FIGS. 10 and 11, the front part 70 comprises a sheet metal member formed to provide a C-section top flange 63 which fits over the top of the crosspiece 55, and a rearwardly directed bottom flange 64 which fits below the crosspiece 55, as shown in FIG.

11. A front face of the front part 70 is bonded to the rear of the bag 10.

Figure 12:
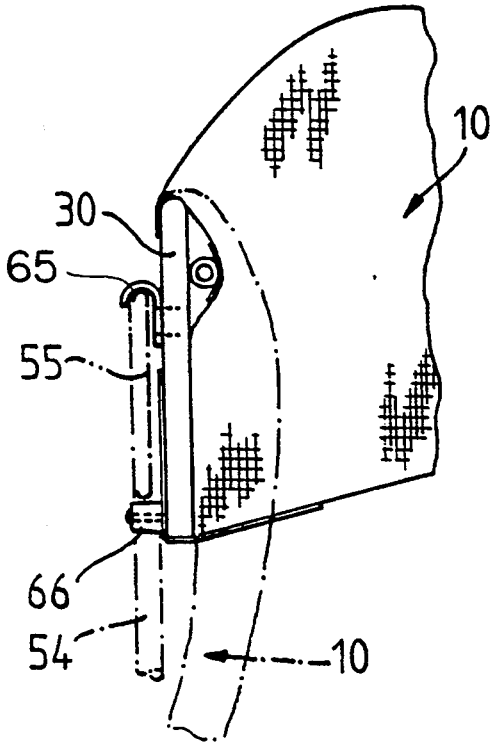

In the modified form shown in FIG. 12, the upright member 30 is retained (without the support member 31) and is provided with a pair of hooks 65 and a lower stop 66 which respectively engage over and fits below the crosspiece 55.

Figure 13:
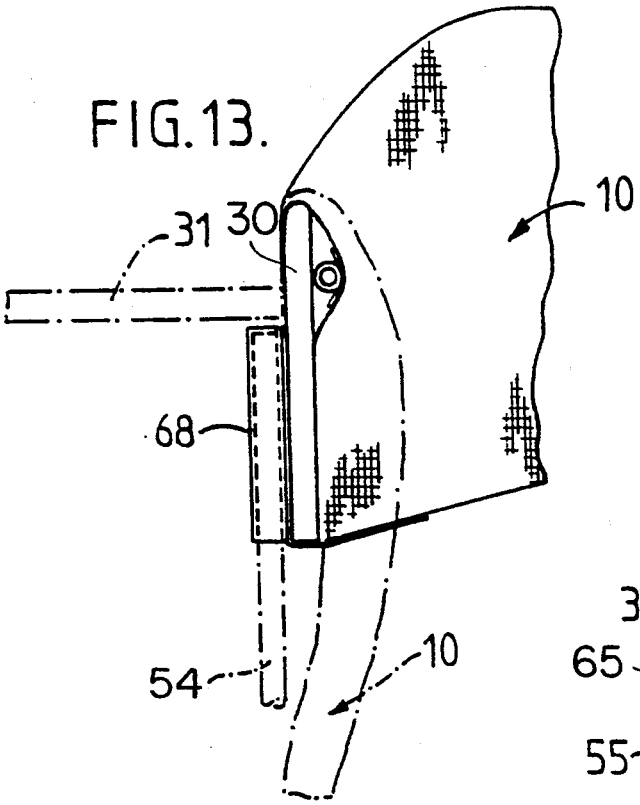
FIGS. 12 and 13 show details of two modified forms of the fifth embodiment.

In the further modified form shown in FIG. 13, the rear support part of the mounting 11B comprises only the two locating members 53 which serve as detachable support members. The upright member 30 is again retained and two upright tubular sockets 68 are secured at the rear of the upright member 30 to receive the uprights 54. Securing means such as fastening means 58 may be transferred to the sockets 68 to secure the selected relative vertical and angular positions of the uprights 54 in the sockets 68. The support member 31 may also be retained, reduced in width to fit between the sockets 68, and made pivotal for movement between a rearwardly projecting position (indicated in broken lines in FIG. 13) and a position lying against the member 30 between the sockets 68.

In all embodiments, the mounting is configured or arranged to support the front part of the mounting so as to provide a heel reception space below the front part of the mounting so that, when the bag is deflated, any vertical space between the chair or bed base and the floor is left sufficiently accessible to enable a user's feet to be moved, via the heel reception space, into said vertical space, to facilitate the user achieving a balance when rising from a seated to a standing position, and thus egress from the chair.

The invention is not confined to details of the foregoing examples, and many variations and modifications are possible within the scope of the invention. For example, the dimensions and materials employed may be of any suitable form.

The apertures 34 can accept tethers if the device is to be tethered to a chair or bed; or may accept a peg or hook so that the device can be hung up thereon when not in use. The rear end of the support member 31 may be rounded, and a transverse ridge may be formed thereon to serve as a non-penetrating barb for engaging the base or mattress.

The invention also includes and provides a leg lifting device or other inflatable support having any novel part, functional feature or combination of parts and or features of form or function disclosed herein or in the accompanying drawings.

We claim:

1. A lifting device comprising:

a) a mounting and a pneumatically inflatable bag having a rear portion secured to a front part of the mounting;

b) said mounting including a support part extending rearwardly from said front part of the mounting;

c) said inflatable bag including an inflatable free end portion which raises from a deflated position dependant below the level of the front part of the mounting to an inflated position above the level of the front part of the mounting, d) said bag including a connecting part located at the bag rear portion and an intermediate portion located between the connecting part and the free end portion, e) said connecting part being attached to the mounting, f) said free end portion rises above the mounting as the end portion becomes inflated, g) said intermediate portion serves as a hinge zone about which the free end portion moves upwardly in a quasi,pivotal manner, and h) said free end portion is, when inflated, thinner than the remainder of the bag.

2. A lifting device comprising:

a) a mounting and a pneumatically inflatable bag having a rear portion secured to a front part of the mounting;

b) said mounting including a support part extending rearwardly from said front part of the mounting;

c) said inflatable bag including an inflatable free end portion which raises from a deflated position dependant below the level of the front part of the mounting to an inflated position above the level of the front part of the mounting, d) said bag including a connecting part located at the bag rear portion and an intermediate portion located between the connecting part and the free end portion, e) said connecting part being attached to the mounting, f) said free end portion rises above the mounting as the end portion becomes inflated, g) said intermediate portion serves as a hinge zone about which the free end portion moves upwardly in a quasi-pivotal manner, and h) said bag is constrained by having a further inflatable bag attached to a lower portion of the bag.

3. A lifting device comprising:

a) a mounting and a pneumatically inflatable bag having a rear portion secured to a front part of the mounting;

b) said mounting including a support part extending rearwardly from said front part of the mounting;

c) said inflatable bag including an inflatable free end portion which raises from a deflated position dependant below the level of the front part of the mounting to an inflated position above the level of the front part of the mounting, d) said device is horizontally elongate so that the free, end portion, when inflated to an upstanding condition, can serve as side member for a cot or bed, to prevent a person from rolling out of the cot or bed.

4. A lifting device comprising:

a) an inflatable bag and a mounting, b) said bag having a rear portion and said mounting including a front part attached or attachable to said rear portion of the bag, c) said mounting including a rear support part having abutment means for interposition between an item of furniture and a floor on which said furniture item is supported, d) the mounting is adjustable between the front part and the abutment means, and e) the inflatable bag is inflatable to provide a pneumatically resilient leg supporting cushion projecting from said mounting.

5. A device as claimed in claim 4 wherein the rear support part includes locating members which carry the abutment means on which part of a chair can rest to hold down the locating members.

6. A device as claimed in claim 4 wherein the rear support part includes means for reducing the overall dimensions of the rear support part for stowing the rear support part in a volume less than 20% greater than that required for stowage of the deflated bag and its attached parts.

7. A device as claimed in claim 5 wherein the front part of the mounting is separable from the support part of the mounting; and the inflatable bag is attached to the front part of the mounting to project upwardly or in cantilever manner from the mounting when inflated.

8. A lifting device comprising:

a) a mounting and a pneumatically inflatable bag having a rear portion secured to a front part of the mounting;

b) said mounting including a support part extending rearwardly from said front part of the mounting;

c) said inflatable bag including an inflatable free end portion which raises from a deflated position dependant below the level of the front part of the mounting to an inflated position above the level of the front part of the mounting, d) said inflatable bag being disposed adjacent a support for a person to provide a pneumatically soft and resilient support for the underside of a user's leg during lifting, and e) said inflatable bag having a heel reception space located below the front part of the mounting.

9. An apparatus for providing mechanical assistance to a person disposed on support means for supporting the person at a location spaced upwardly from a floor, said apparatus comprising:

a) inflatable bag means including a rear portion having mounting means for disposing the inflatable bag adjacent said support means to provide said mechanical assistance, b) said bag including an inflatable free end portion that raises from a deflated position dependant below an upper supporting surface of the support means to an inflated position above the mounting means.

10. An apparatus as claimed in claim 9 wherein the bag includes an intermediate portion located between the mounting means and the inflatable free end portion, said intermediate portion being effective to rise above the mounting means and serves as a hinge zone about which the free end portion moves upwardly in a quasi-pivotal manner as the bag means is inflated.

11. An apparatus as claimed in claim 10 wherein the free end portion is, when inflated, thinner than the remainder of the bag means.

12. An apparatus as claimed in claim 10 wherein the bag means includes a first bag section with said inflated free end portion and a second bag section attached to a lower portion of the first bag section.

13. An apparatus as claimed in claim 9 wherein the apparatus is horizontally elongate so that the free end portion, when inflated to an upstanding inflated position serves as a side member for the support means to prevent a person from rolling off said support means.

14. An apparatus as claimed in claim 9 wherein the mounting means includes a front portion attachable to said rear portion, and a rear bag support portion.

15. An apparatus as claimed in claim 14 wherein the rear bag support portion includes means for disposing the inflatable bag as a pneumatically resilient leg supporting cushion projecting from said mounting means.

16. An apparatus as claimed in claim 15 wherein the rear bag support portion includes locating members having means for abutting said support means to hold down the locating members.

17. An apparatus as claimed in claim 16 wherein said locating members include telescoping rod means for vertically supporting said rear bag support portion, and fastening means for securing said telescoping rod means at a level to position the inflatable bag at the side of said support means.

18. An apparatus as claimed in claim 15 wherein the mounting means front portion is separable from the rear bag support position mounting, and the inflatable bag is attached to the mounting means front portion to project upwardly from the mounting means when inflated.

* * * * *